US006361132B2

(12) United States Patent
Kawanabe

(10) Patent No.: US 6,361,132 B2
(45) Date of Patent: Mar. 26, 2002

(54) OVERHEAD DOORS

(75) Inventor: Masatoshi Kawanabe, Tokyo (JP)

(73) Assignee: Sugatsune Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/858,666

(22) Filed: May 17, 2001

Related U.S. Application Data

(62) Division of application No. 08/518,509, filed on Aug. 23, 1995, now abandoned.

(30) Foreign Application Priority Data

Aug. 24, 1994 (JP) ..... 6-222424

(51) Int. Cl.[7] ..... A47B 88/00
(52) U.S. Cl. ..... 312/319.2; 312/322
(58) Field of Search ..... 312/322, 323, 312/326, 327, 315, 319.1, 319.2, 319.4; 267/155; 16/362, DIG. 10; 49/206, 250

(56) References Cited

U.S. PATENT DOCUMENTS

| | | | | | |
|---|---|---|---|---|---|
| 1,447,060 | A | * | 2/1923 | Boughton | 49/206 X |
| 2,203,856 | A | * | 6/1940 | Beason | 49/206 |
| 2,388,654 | A | * | 11/1945 | Holmes | 49/206 |
| 2,390,086 | A | * | 12/1945 | Ferris | 49/206 |
| 2,634,454 | A | * | 4/1953 | Altenburger | 267/155 X |
| 3,771,847 | A | * | 11/1973 | Aylworth | 312/245 |
| RE28,994 | E | * | 10/1976 | Aylworth | 312/323 X |
| 4,516,813 | A | * | 5/1985 | Sekerich | 312/323 |
| 4,938,322 | A | * | 7/1990 | Sugasawara et al. | 16/51 X |
| 5,079,797 | A | * | 1/1992 | Ohshima et al. | 16/DIG. 9 X |
| 5,353,899 | A | * | 10/1994 | Ohshima | 188/310 |
| 5,399,010 | A | * | 3/1995 | McClung et al. | 312/322 X |
| 5,409,308 | A | * | 4/1995 | Reuter et al. | 312/319.4 |
| 5,524,979 | A | * | 6/1996 | Carson et al. | 312/319.2 |
| 5,530,993 | A | * | 7/1996 | Hayakawa | 16/362 X |
| 5,645,333 | A | * | 7/1997 | Sakurai | 312/319.2 X |

FOREIGN PATENT DOCUMENTS

| | | | | |
|---|---|---|---|---|
| FR | 1484719 | * | 5/1967 | 49/250 |
| IT | 505505 | * | 12/1954 | 267/155 |
| JP | 11934 | * | 1/1990 | 267/155 |

* cited by examiner

*Primary Examiner*—James O. Hansen
(74) *Attorney, Agent, or Firm*—Jacobson Holman, PLLC

(57) ABSTRACT

An overhead door with a pair of stays and a respective stay holding tension springs. Each of the stays is rotatably fitted to the inner surface of a corresponding lateral wall of a cabinet main body by way of a rotary shaft and have their front end pivotably secured to the door at a position close to the lower edge of the door. Each of the stay holding tension springs are so arranged that each of them is hooked at an end to a position located upward and forward relative to the corresponding rotary shaft on the inner surface of the related lateral wall of the cabinet main body and at the opposite end to a middle point of the corresponding stay.

3 Claims, 5 Drawing Sheets

OVERHEAD DOORS

This is a divisional of application Ser. No. 08/518,509 filed Aug. 23, 1995 now abandoned.

BACKGROUND OF THE INVENTION

1. Field of the Invention

This invention relates to an overhead door suspended from the top of an opening of a cabinet or the like and capable of being lifted until it is placed on the roof wall of the cabinet to keep the door open.

2. Prior Art

FIG. 9 of the accompanying drawing illustrates a known overhead door a designed to be lifted and placed under the roof wall c of a cabinet main body b (Japanese Utility Model Publication No. 60-18528).

A known overhead door of the above-described type is, however, accompanied by a number of drawbacks including that it has a rather complicated configuration of comprising a support rod d and a short rod e arranged for swinging the door a up and down as well as a spring f fitted thereto, that a slide assembly constituted by a slide rail g and a door wheel h is arranged within the cabinet main body to make it rather cumbersome to secure the door a to a cabinet main body b and positionally adjust the door a once it has been secured to the cabinet main body b and that the space available within the cabinet b is limited because it has to accommodate the door a within it.

Additionally, when the door a is opened, the cabinet becomes esthetically unattractive because of the exposed support rod d and spring f and, during the operation of opening or closing the door, the finger of the user operating the door may be accidentally caught and pinched by the spring f or between the spring f and the support rod d.

In view of the above identified problems and other problems of known overhead doors of the type under consideration, the inventor of the present invention has proposed an overhead door as illustrated in FIG. 8 of the accompanying drawings.

With the illustrated arrangement, a support arm k is pivotably fitted at an end to the inner surface of each lateral wall of a cabinet main body i or the like by way of or without a damper j and at the opposite end to the rear surface of a door m by means of a pin n at a position close to the lower edge of the door. On the other hand, the door m is swingable fitted to the front edge of the roof plate p of the cabinet main body by means of hinges r so that it may be moved between a fully closed position for completely closing the cabinet and a raised position where it rests on the roof plate p to fully open the cabinet through its swinging and sliding motion realized by using a pair of slide rail assemblies q, each of which comprises an inner rail u and an outer rail v. At the same time, a pair of vertical grooves s are formed on the rear surface of the door m to respectively accommodate a pair of tension springs t, each of which is secured at the opposite ends to the upper end of the corresponding hinge r and the lower end s' of the groove s in order to urge the outer rail v and the door m upward relative to the inner rail u of the slide rail assembly q.

The above arrangement is, however, still accompanied by a problem as described below.

As the door m is pulled downward from the open position to swing down to the closed position, the tension springs t are expanded to show a length four times as long as their contracted length for the door in a fully open state. Since the door m is made open for about 8 hours a day in average and remains closed for the rest of the day, the time during which the tension spring t is expanded is by far longer than the time when it remains in a contracted state so that consequently the service life of the tension springs may be undesirably short.

In view of the above problem, it is therefore an object of the invention to provide an overhead door of a cabinet or the like equipped with a pair of slide rail assemblies as described above by referring to FIG. 8 and also with a pair of stays, each having its base end rotatably fitted to the inner surface of a corresponding lateral wall of a cabinet to which the door is linked and its front end pivotably fitted to the rear surface of the door at a position close to the lower edge of the door, and a pair of stay holding tension springs provided for the respective stays, each extending between a middle point of the corresponding stay and an appropriate position on the inner surface of the corresponding lateral wall of the cabinet, so that the stay holding tension springs may be expanded to a length only twice as long as their contracted length in order to improve their service life and ensure the door to operate smoothly for opening and closing for a prolonged period of time, while the door and the attachments may not provide any obstacle for the operation of storing and retrieving objects in and from the cabinet once the door is swung upward for opening and placed on the roof plate nor the stay holding tension springs may expand out of the opening of the cabinet to accidentally pinch a finger tip of the user.

An overhead door according to the invention may be equipped not only with stay holding tension springs as described above but also with a pair of grooves arranged on the rear surface for accommodating the respective door holding tension springs as in the case of the above described prior art overhead door so that the tension springs may not move out from the door during opening and closing operations. With such an arrangement, the risk for the stay holding tension springs of accidentally pinching a finger tip of the user can be effectively eliminated when the door is being opened or closed and the operation of opening and closing the door proceeds smoothly and slowly without requiring substantial force on the part of the user because of the joint effect of the door and stay holding tension springs. Additionally, the service life of the door and stay holding tension springs can be considerably expanded as the load of moving the door is borne by all of them.

Alternatively, the door may be movably held to the adjacent lateral walls of the cabinet not simply by means of respective stays having their ends pivotably secured to the lateral walls and the door but by way of a damper disposed between the base end of each of the support arms and the related lateral wall so that, when the door is closed from the open position where it is located on the roof wall, it is moved only slowly and softly due to the resistance or the damping effect of the damper against the torque of the door produced by its load.

Preferably, an overhead door according to the invention may be provided with a combination of dampers and door and stay holding tension springs arranged at appropriate locations so that both the braking force of the dampers and the restoring force of the expanded springs may be exploited to decelerate the speed and lessen the load with which the door is swung open or closed and consequently no substantial effort is required for the user to open or close the door.

Alternatively, an overhead door according to the invention may be provided with a combination of dampers and coil springs arranged at appropriate locations so that both the braking force of the dampers and the restoring force of the coil springs may be exploited to decelerate the speed and lessen the load with which the door is swung open or closed and consequently no substantial effort is required for the user to open or close the door.

Still alternatively, an overhead door according to the invention may be provided with a combination of dampers, door holding tension springs and coil springs arranged at appropriate locations so that all the braking force of the dampers, the restoring force of the expanded springs and the coil springs may be fully exploited to further decelerate the speed and lessen the load with which the door is swung open or closed and consequently no substantial effort is required for the user to open or close the door.

SUMMARY OF THE INVENTION

According to a first aspect of the invention, the above object is achieved by providing an overhead door swingably secured to the inner lateral wall surfaces of a cabinet or the like by means of a pair of stays such that the base end of each of the stays is rotatably secured to the inner surface of the corresponding lateral wall of the cabinet and the front end is pivotably fitted to the inner surface of the door at a position close to the lower edge thereof, characterized in that it is provided on the inner surface thereof with a pair of longitudinally arranged slide rail assemblies, each comprising a relatively long outer rail and a relatively short inner rail slidable relative to each other and being pivotably secured at the upper end to the front edge of the roof wall of the cabinet by means of a hinge, so that the door can be swung open or closed as a combined effect of slewing and sliding motions and, when fully opened, it is placed on the roof wall of the cabinet, and also with a pair of stay holding tension springs, each arranged between a position upwardly and forwardly displaced from the base end of the corresponding stay on the inner surface of the related lateral wall of the cabinet and a middle position of the stay, in order to urge the outer rails and the door upward relative to the inner rails.

An overhead door as described above may additionally be provided with a pair of longitudinal grooves for accommodating respective door holding tension springs, each arranged between the upper end of the corresponding hinge and the lower end of the corresponding groove, in order to decelerate any downward movement and accelerate any upward movement of the outer rails and the door relative to the inner rails.

According to a second aspect of the invention, there is provided an overhead door swingably secured to the inner lateral wall surfaces of a cabinet or the like by means of a pair of dampers and a pair of stays such that the rotary shaft of each of the dampers is rigidly secured to the inner surface of the corresponding lateral wall of the cabinet and the base end of the corresponding stay is rigidly fitted to the main body of the damper while its front end is pivotably fitted to the inner surface of the door at a position close to the lower edge thereof, characterized in that it is provided on the inner surface thereof with a pair of longitudinally arranged slide rail assemblies, each comprising a relatively long outer rail and a relatively short inner rail slidable relative to each other and being pivotably secured at the upper end to the front edge of the roof wall of the cabinet by means of a hinge, so that the door can be swung open or closed as a combined effect of slewing and sliding motions and, when fully opened, it is placed on the roof wall of the cabinet, and also with a pair of stay holding tension springs, each being arranged between a position upwardly and forwardly displaced from the base end of the corresponding stay on the inner surface of the related lateral wall of the cabinet and a middle position of the stay, in order to urge the outer rails and the door upward relative to the inner rails.

An overhead door as described above may additionally be provided with a pair of longitudinal grooves for accommodating respective door holding tension springs, each arranged between the upper end of the corresponding hinge and the lower end of the corresponding groove, in order to decelerate any downward movement and accelerate any upward movement of the outer rails and the door relative to the inner rails.

According to a third aspect of the invention, there is provided an overhead door swingably secured to the inner lateral wall surfaces of a cabinet or the like by means of a pair of dampers and a pair of stays such that the rotary shaft of each of the dampers is rigidly secured to the inner surface of the corresponding lateral wall of the cabinet and the base end of the corresponding stay is rigidly fitted to the main body of the damper while its front end is pivotably fitted to the inner surface of the door at a position close to the lower edge thereof, characterized in that it is provided on the inner surface thereof with a pair of longitudinally arranged slide rail assemblies, each comprising a relatively long outer rail and a relatively short inner rail slidable relative to each other and being pivotably secured at the upper end to the front edge of the roof wall of the cabinet by means of a hinge, so that the door can be swung open or closed as a combined effect of slewing and sliding motions and, when fully opened, it is placed on the roof wall of the cabinet, and also with a pair of stay holding tension springs, each being arranged between a position upwardly and forwardly displaced from the base end of the corresponding stay on the inner surface of the related lateral wall of the cabinet and a middle position of the stay, in order to urge the outer rails and the door upward relative to the inner rails, and the dampers are provided with respective coil springs, each having its ends hooked to the rotary shaft and the main body of the corresponding damper, such that they are wound tightly as the door is rotated toward its closed position in order to urge the outer rails and the door upward relative to the inner rails by the resilient force of the coil springs.

An overhead door as described above may additionally be provided with a pair of longitudinal grooves for accommodating respective door holding tension springs, each arranged between the upper end of the corresponding hinge and the lower end of the corresponding groove, in order to decelerate any downward movement and accelerate any upward movement of the outer rails and the door relative to the inner rails, the dampers being provided with respective coil springs, each having its ends hooked to the rotary shaft and the main body of the corresponding damper, such that they are wound tightly as the door is rotated toward its closed position in order to urge the outer rails and the door upward relative to the inner rails by the resilient force of the coil springs.

DETAILED DESCRIPTION OF THE INVENTION

Figure 1:
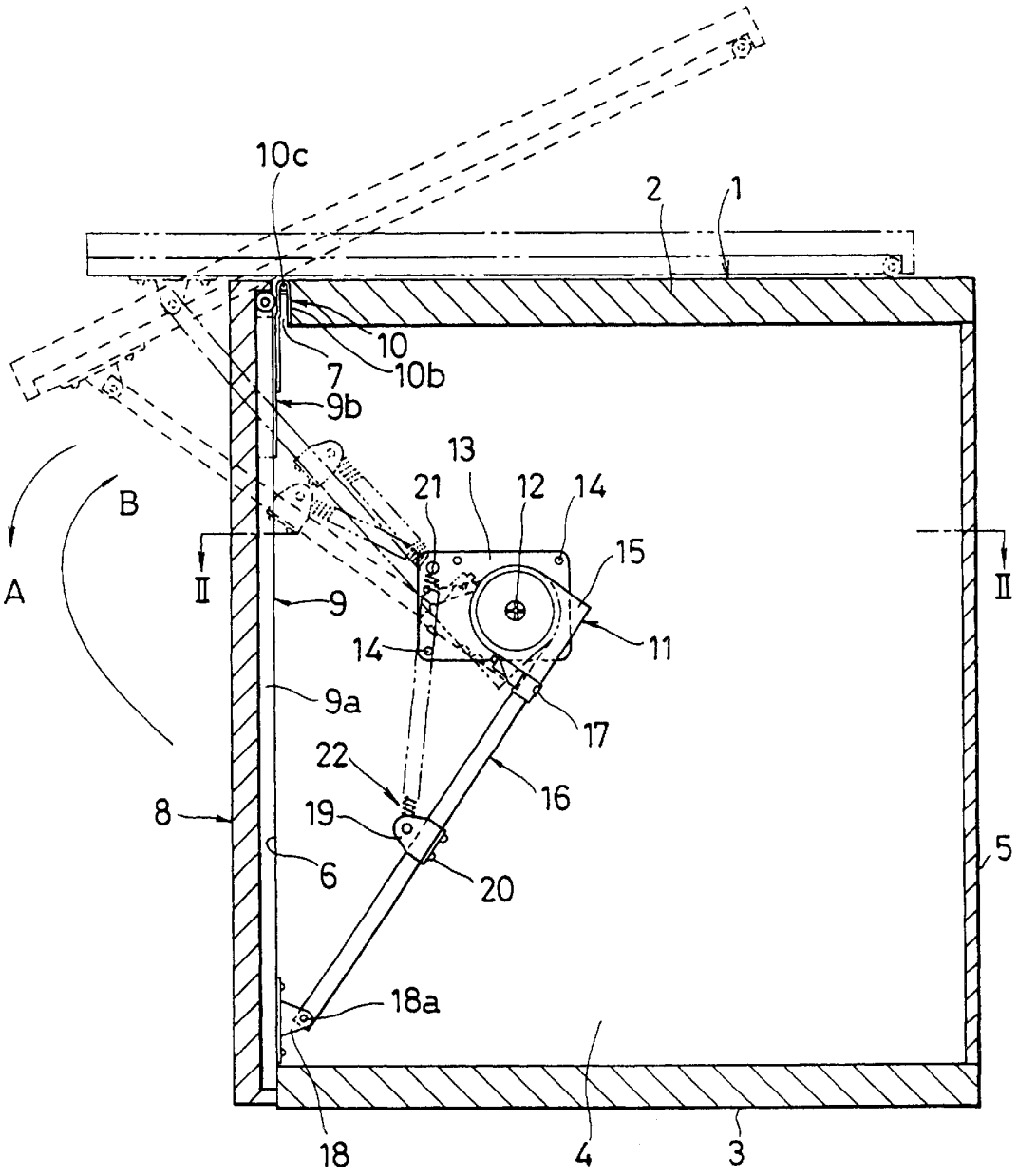
FIG. 1 is a cross sectional side view of a cabinet provided with a preferred embodiment of overhead door according to the invention, the door being shown in a closed position.
Figure 2:
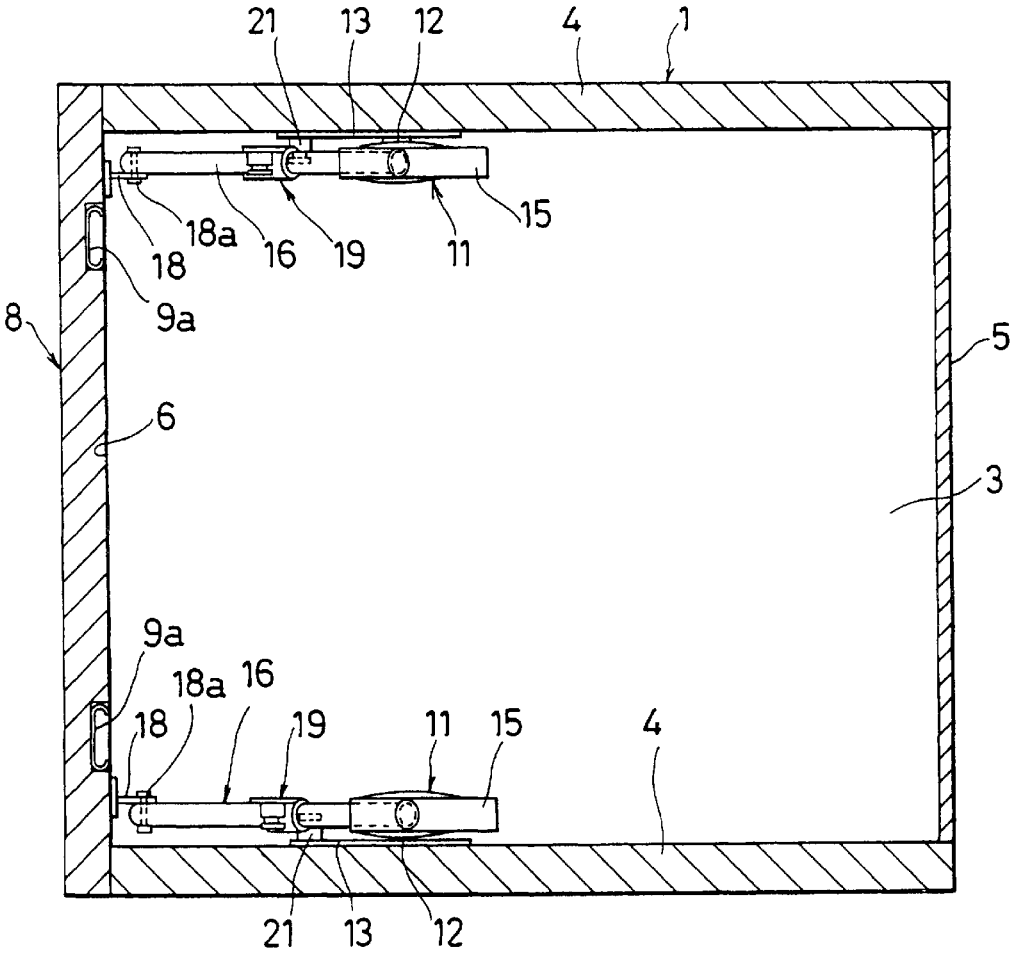
FIG. 2 is a cross sectional plane view of the embodiment of FIG. 1 taken along line II—II.
Figure 3:
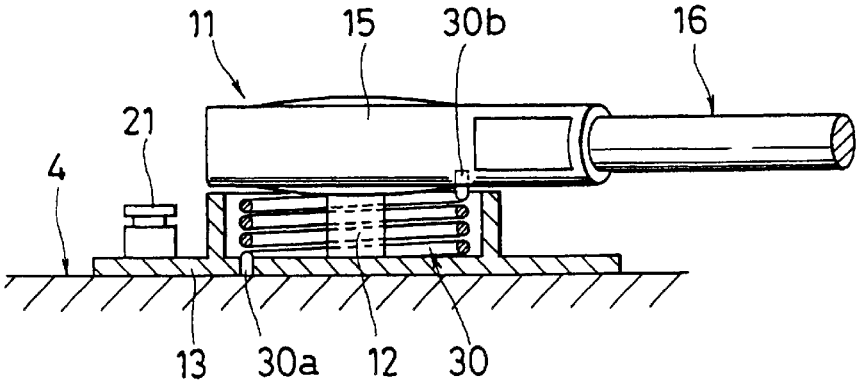
FIG. 3 is a partially torn out lateral view of a damper having a coil spring of the embodiment of FIG. 1.
Figure 4:
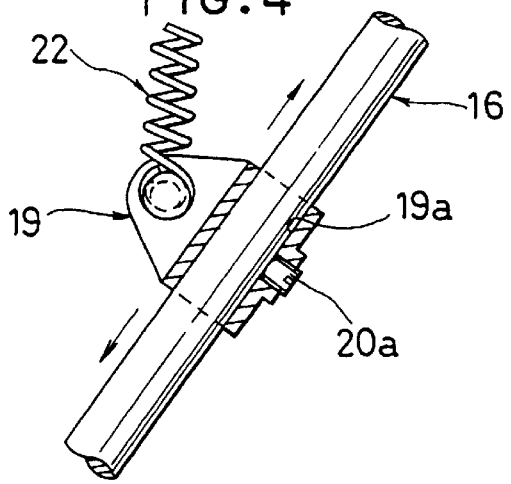
FIG. 4 is a partially torn out lateral view of a tension regulating mechanism of a stay holding tension spring that can be used for the purpose of the invention.
Figure 5:
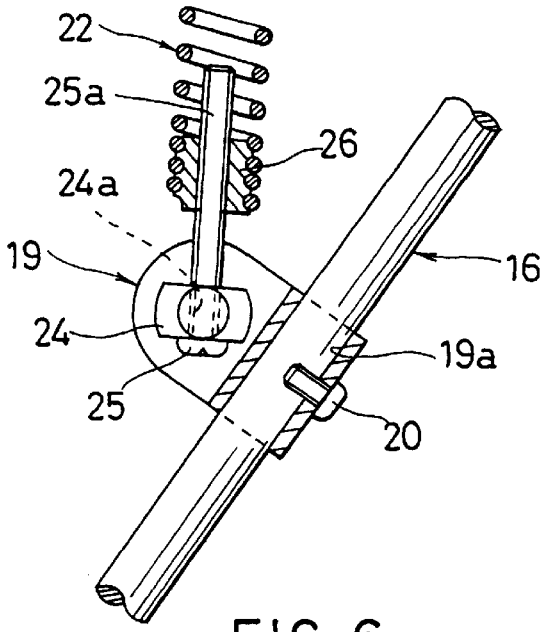
FIG. 5 is a partially torn out lateral view of another tension regulating mechanism of a stay holding tension spring that can be used for the purpose of the invention.
Figure 6:
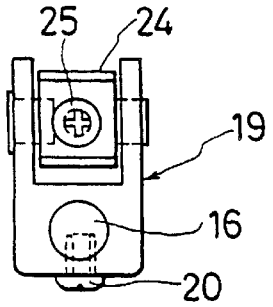
FIG. 6 is a front view of a bracket of the tension regulating mechanism of a stay holding tension spring of FIG. 5.
Figure 7:
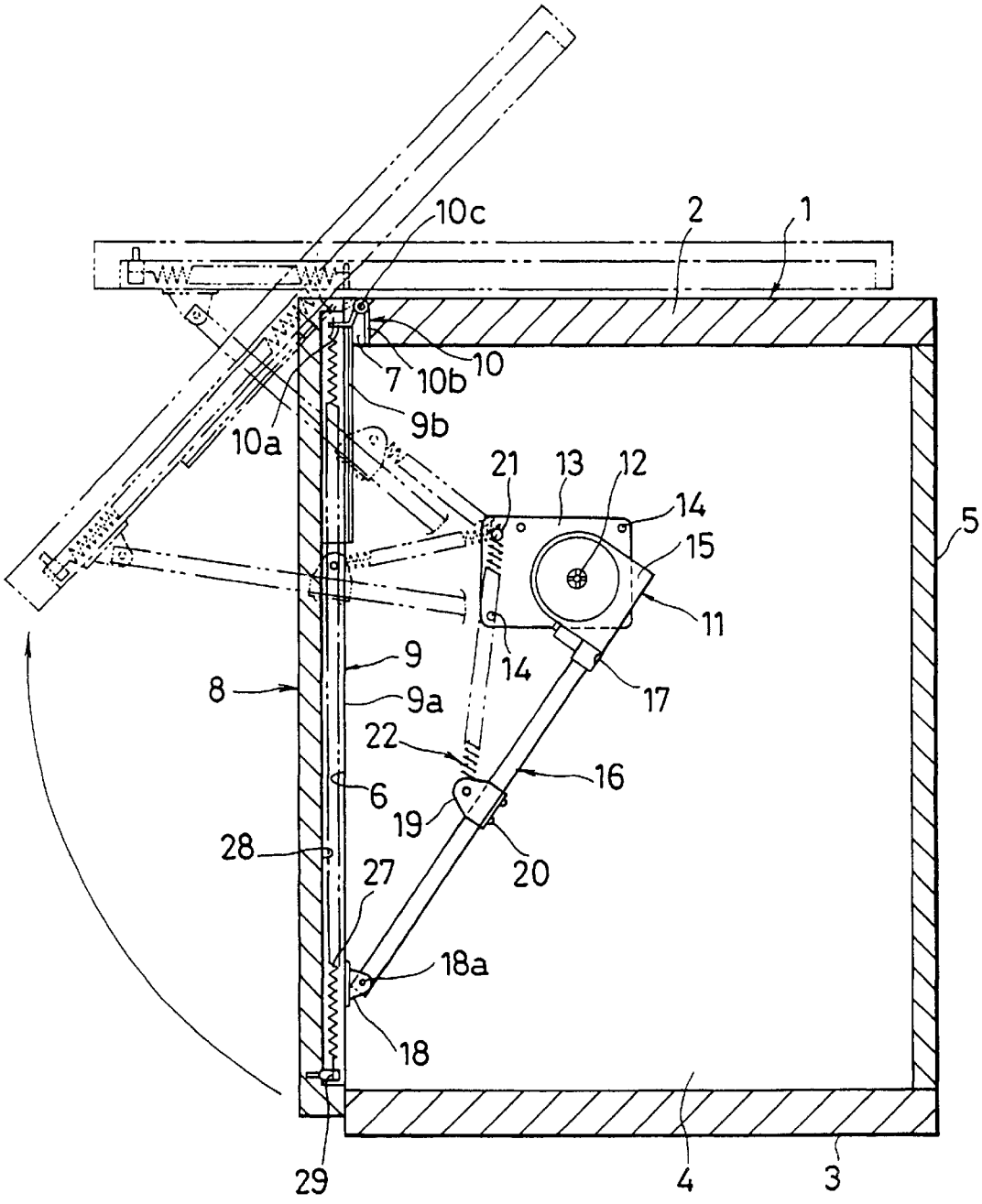
FIG. 7 is a cross sectional side view of a cabinet provided with another preferred embodiment of overhead door according to the invention, the door being shown in a closed position.
Figure 8:
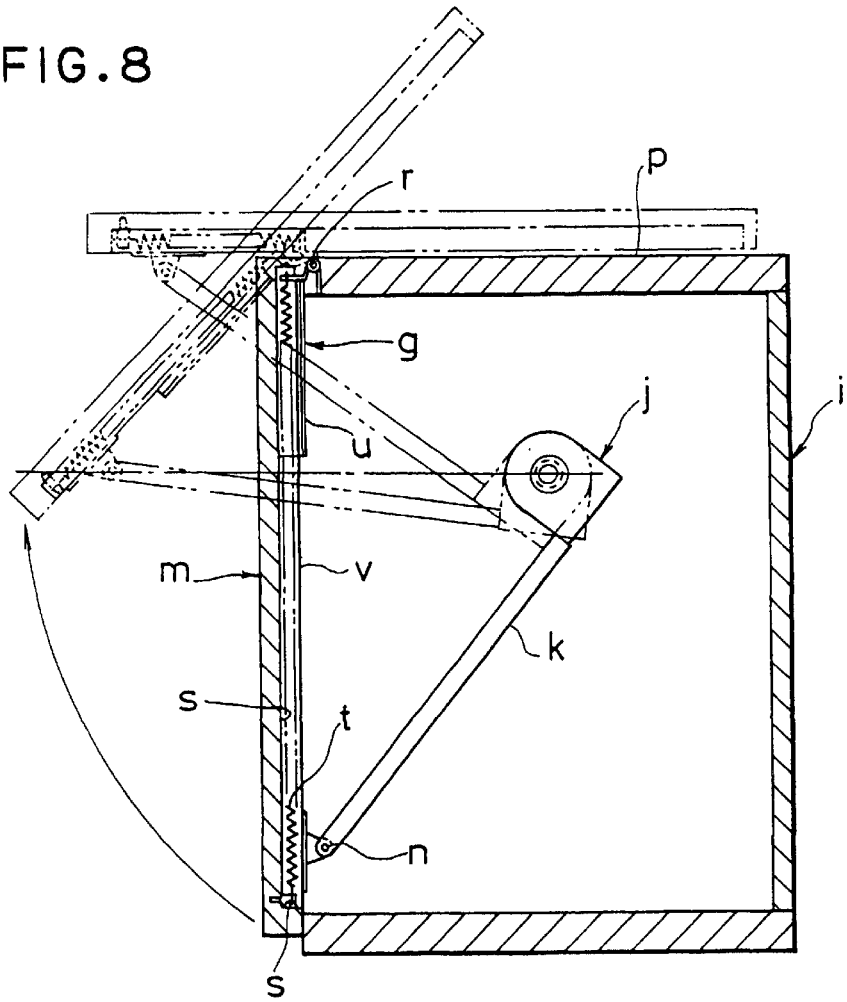
FIG. 8 is a cross sectional side view of a cabinet provided with another overhead door proposed by the inventor of the present invention, the door being shown in a closed position.
Figure 9:
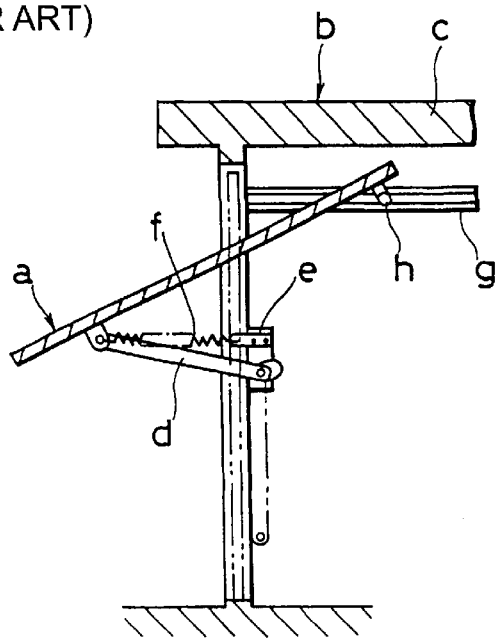
FIG. 9 (PRIOR ART)
FIG. 9 illustrates a known overhead door designed to be lifted and placed under the roof wall of a cabinet main body.

Note that FIGS. 1 and 2 are applicable to an overhead door according to the first or second aspect of the invention while FIG. 3 is referred to only for the description of an overhead door according to the third aspect of the invention. FIGS. 4, 5 and 6 are applicable to all the aspects of the invention and FIG. 7 is referred to for a preferable mode of carrying out the invention. Throughout the drawings, reference numeral 1 generally denotes a cabinet main body comprising a roof wall 2, a bottom wall 3, a pair of lateral walls 4, a rear wall 5 to produce an opening 6 on the front side thereof. The roof wall 2 is provided at lateral positions on the front edge thereof with a pair of recesses 7, for receiving respective hinges 10, which will be described hereinafter.

A door 8 made of a thick panel is dimensioned so as to completely cover the opening 6 and the surrounding walls if viewed from the front side and provided on the inner surface with a pair of slide rail assemblies running longitudinally, said slide rail assemblies being held to the door 8 by rigidly securing the outer rails 9*a* of the assemblies to the door 8.

The slide rail assemblies 9, may be of any known type and each of them comprises a relatively long outer rail 9*a* and a relatively short inner rail 9*b* arranged vis-a-vis with a wall retainer (not shown) interposed therebetween, said wall retainer retaining a plurality of steel balls (not shown) in such a way that the outer rail 9*a* may freely slide and move relative to the inner rail 9*b*. The inner rails 9*b*, are fitted at the inner surface of the top thereof to the respective hinges 10, which are secured to the respective recesses 7, of the roof wall 2. This description applies to any overhead door according to the invention.

The door 8 is provided near the lower edge on the inner surface thereof with a pair of brackets 18, each of which is designed to pivotably receive the front end of a stay 16 by way of a pin 18*a*. The base end of each of the stays 16, is rotatably supported by a rotary shaft 12 fitted to inner surface of the corresponding lateral wall 4 of the cabinet main body 1 at a position displaced upward from the center thereof of each embodiment according to the first aspect of the invention. Thus, the door 8 is opened by rotating it upward and closed by rotating it downward with a radius of rotation equal to the length of the stays as clearly illustrated in FIGS. 1 and 2.

In each embodiment according to the second or third aspect of the invention, the base end of each of the stays 16, does not directly rotate around a rotary shaft 12 but rigidly secured to a substantially cylindrical main body 15 of a damper 11 by thread engagement as indicated by 17 in FIG. 1, which damper 11 is rigidly fitted to the inner surface of the corresponding lateral wall by means of screws 14, around the rotary shaft 12 such that when the overhead door 8 is turned to its closed position, the door is made to move slowly and softly as the torque applied to the door is dampened by the dampers 11.

The stays 16, are provided at a middle position thereof with respective brackets 19, which are secured to the stays by means of screws 20. A pair of door holding tension springs 27, are arranged respectively between the brackets 19, and the lateral walls 4, in each embodiment according to the first aspect of the invention, whereas they are arranged respectively between the brackets 19, and spring hooks 21, projecting from base plates 13, of the dampers 11, by which the rotary shafts 12, are rigidly secured. With this arrangement, the outer rails 9*a*, and the door 8 may jointly slide up and down relative to the inner rails 9*b*, and are urged to open the door by the stay holding tension springs 22, and, when the overhead door 8 is turned to its closed position, the door is made to move slowly and softly as the torque applied to the door is dampened by the dampers 11.

The brackets 19, may not necessarily be rigidly fitted to the respective stays 16, by means of screws 20, as shown in FIG. 1 but alternatively be provided with respective through bores 19*a*, for slidably receiving the stays 16, although the brackets 19, may be secured to the respective stays 16, by means of pressing screws 20*a*, as shown in FIG. 4 so that the relative positions of the brackets 19, on the stays 16, may be modified longitudinally to regulate the tension of the stay holding tension springs 22, as a function of the size and weight of the door 8 and other factors.

The tension regulation mechanism for the stay holding tension spring 22 of FIG. 4 may be so modified that, as shown in FIGS. 5 and 6, the bracket 19 is secured to the stay 16 by means of a screw 20 and a rotary member 24 is pivotably fitted to the bracket 19 and provided with a through hole 24*a* for rotatably holding an adjuster screw 25 having a threaded section 25*a* that receives a movable spring hook 26 by thread engagement such that an end of the stay holding tension spring 22 is hooked to the movable spring hook 26. With this arrangement, the movable spring hook 26 moves back or forth along the threaded section 25*a* of the adjuster screw 25 as the latter is rotated clockwise or counterclockwise to consequently regulate the tension of the stay holding tension spring 22.

In a preferable mode of carrying out the invention, the overhead door 8 is provided on the inner surface thereof with a pair of longitudinal grooves 28, running along the respective slide rail assemblies 9, for accommodating respective door holding tension springs 27.

Each of the door holding tension springs 27, has its one end hooked to a spring hook 10*a* projecting from the upper end of the corresponding hinge 10 toward the opening 6 of the cabinet main body and its opposite end hooked to another spring hook 29 partly embedded into the lower end of the groove 28 so that it is housed in the groove 28 under an expanded condition.

The hinge body 10*b* of each of the hinges 10, is rigidly secured to a corresponding recess 7 formed on the roof board 2 of the cabinet main body 1 by means of screws (not shown) so that consequently the door 8 may vertically rotate around the axes 10*c*, of the hinges 10, 10 and at the same time vertically slide with the outer rails 9*a*, relative to the inner rails 9*b*, as it is urged upward by the restoring force of the expanded door holding tension spring tension springs 27, as in the case of the above-described preferred mode of carrying the invention.

Note that while not only the door holding tension springs 27, but also the slide rail assemblies 9, are housed in the grooves 28, in the illustrated embodiment, the latter may be directly fitted to the inner surface of the overhead door 8 instead of being housed in the respective grooves 28.

The overhead door 8 may be additionally provided with a pair of coil springs 30, each of which is hooked at an end 30*a* to the base plate 13 of the corresponding damper 11 and at the opposite end 30*b* to the main body 15 of the damper 11 as shown in FIG. 3, so that they are tightened to exert a damping effect to the door 8 when the opened door 8 placed on the roof wall of the cabinet main body and indicated by dotted broken lines in FIG. 1 is pivoted and pulled downward along arrow A and urges the door 8 to pivot and rise to its open position along arrow B by the tensile force of the tightened coil springs 30, in addition to the tensile force of the stay holding tension springs 22. Therefore, it will be understood that, if coil springs 30, are used in combination with the dampers 11, the tensile force of the stay holding tension springs 22, are added to that of the door holding tension springs 27.

Thus, with the arrangement according to the first aspect of the invention, as the door 8 is held by hand at the lower end thereof and pulled upward toward its open position, the pulling force is transformed into rotary power and transmitted to the stays 16, by the door 8 so that the base ends of the stays 16, rotate around the respective rotary shaft 12, to make the door 8 also rotate around the axes 10*c*, 10*c* of the hinges 10, where the upper ends of the inner rails 9*b*, are linked to the front edge of the roof board 2 of the cabinet main body, from the vertical position to an inclined position under the urging force of the stay holding tension springs 22. Consequently, the outer rails 9*a*, and the door 8 are made to slide upward along the inner rail 9*b*, by the tensile force of the stay holding tension springs 22, so that the door 8 rotates as it is pulled upward until it is laid flat on the roof board 2 of the cabinet main body 1.

For closing the door 8, it is slightly pulled forward by hand against the tensile force of the stay holding tension springs 22, and then pulled down by holding the front edge of the door 8. Then, the downward force applied to the door 8 is transformed into rotary power and transmitted to the stays 16, by the slide rail assemblies 9, so that the slide rail assemblies 9, rotate around the respective axes 10*c*, of the hinges 10, while the door 8 is rotated around the rotary shafts 12, by the stays 16, expanding the stay holding tension springs 22, to store resilient force therein for the next door opening operation. Note that, since each of the stay holding tension springs 22, extends between a position located upward and forward relative to the corresponding rotary shaft 12 on the inner surface of the related lateral wall 4 of the cabinet main body (or a position closer to the opening of the cabinet main body) and a middle point of the stay 16, the extent to which the stay holding tension springs 22, are expanded for closing the door is less than half of the extent to which the tension springs 22, 22 to alleviate the load applied to the stay holding tension springs 22, when the door is closed.

If the above arrangement is further provided with a pair of door holding tension springs 27, their effect is added to that of the stay holding tension spring 22, so that as the pins 18*a*, by which the stays 16, are pivotably fitted to the door 8 are rotated and moved above the respective rotary shafts 12, by which the stays 16, are pivotably fitted to the respective lateral walls 4, of the cabinet main body 1, the door 8 is subjected to a moment trying to rotate the door 8 upward by the joint tensile force of the tension springs 22, 27, because of the fact the inner rails 9*b*, are pivotably fitted to the front edge of the roof board 2 of the cabinet main body 1 by means of respective hinges 10, and then the outer rails 9*a*, are made to slide upward along with the door 8 as the former are rigidly fitted to the latter until the door 8 is horizontally placed on the roof board 2 of the cabinet main body 1.

As the door 8 lies flat on the roof board 2 of the cabinet main body 1, it is pulled backward by the door holding tension springs 27, and the stay holding tension springs 22, to slide to its fully opened position and remains there if the hand holding the door 8 is removed therefrom.

For closing the door 8 from its fully opened position, it is slightly pulled forward by hand against the tensile force of the tension springs 22, 27, and then pulled down by holding the front edge of the door 8. Then, as described above, the downward force applied to the door 8 is transformed into rotary power and transmitted to the stays 16, by the slide rail assemblies 9, so that the slide rail assemblies 9, rotate around the respective axes 10*c*, of the hinges 10, while the door 8 is rotated around the rotary shafts 12, by the stays 16. When the door is rotated by a given angle, the door is automatically moved downward by the torque applied to it by its own weight to its fully closed position. Note that, since the tension springs 22, 27, are expanded to store resilient force therein for the next door opening operation, which therefore can be carried out very smoothly.

With an embodiment according to the second aspect of the invention, the base end of each of the stays 16, is not directly fitted to the inner surface of the corresponding lateral wall 4 of the cabinet main body 1 but secured to the corresponding damper 11 so that the door 8 does not encounter any substantial resistance of the dampers 11, when it is opened, although the dampers 11, rotate around their respective rotary shafts. Consequently the door 8 rotates very smoothly until it gets to its fully opened position, where it lies flat on the roof board 2 of the cabinet main body 1.

For closing the door 8, to the contrary, the rotary shaft 12 and an inner cylinder (not shown) of each of the dampers 11, are made to rotate relative to the main body 15 in a direction opposite to the one in which they are made to rotate for opening the door 8 to exert damping force to the door that operate to suppress the torque applied to the door by the own weight of the door so that, in combination with the decelerating force of the stay holding tension springs 22, the door 8 rotates very slowly and smoothly until it gets to its fully closed position.

If the above arrangement is further provided with a pair of door holding tension springs 27, that operate in a manner as described earlier, the door 8 does not encounter any substantial resistance of the dampers 11, when it is opened and, since the door holding tension springs 27, have stored sufficient resilient force in them, the door 8 can be opened very easily and smoothly under a joint effect of the stay holding tension springs 22, and the door holding tension springs 27.

For closing the door 8, the gravity of door 8 is dampened not only by the dampers 11, but also by the joint resilient force of the tension springs 22, 27, so that the net effect will be a door closing motion that proceeds very smoothly and reliably if the door is very heavy.

In an embodiment according to the third aspect of the invention, the dampers 11, are provided with respective coil springs 30, that store substantial resilient force as a result of the last closing operation of the door so that the door 8 does not encounter any resistance of the dampers 11, and the opening motion of the door 8 is even accelerated by the resilient force of the coil springs 30, to make the motion very smooth and comfortable.

For a closing operation, the door 8 encounters a damping effect of dampers 11, and the resistance of the coil springs 30, as they are wound tight by the closing motion of the door 8 so that the falling motion of the door 8 is sufficiently decelerated to make the door become closed smoothly and comfortably.

If the above arrangement is further provided with a pair of door holding tension springs 27, that operate in a manner as described earlier, the door 8 does not encounter any substantial resistance of the dampers 11, when it is opened and it can be opened very easily and smoothly under a joint effect of the stay holding tension springs 22, the door holding tension springs 27, and the coil springs 30.

For a closing operation, the door 8 encounters a damping effect of the dampers 11, and the resistance of the coil springs 30, in addition to the resilient force of the tension springs 22, 27, so that the falling motion of the door 8 is sufficiently decelerated to make the door become closed smoothly, reliably and comfortably.

ADVANTAGES OF THE INVENTION

As described above in detail, since an overhead door arrangement according to the first aspect of the invention is pivotably supported by hinges and stays relative to a cabinet main body and fitted to the cabinet main body by means of slide rail assemblies in such a way that the door may be moved completely onto the roof wall of the cabinet main body for fully opening the door, the door does not constitute any obstacle for the operation of storing and retrieving objects in and from the cabinet, while keeping the overhead of the cabinet clear.

Additionally, since the door is provided with a pair of stay holding tension springs in such a way that each extends between the inner surface of the corresponding lateral wall of the cabinet main body and a middle point of the related stay for connecting the lateral wall and the door in order to alleviate the force required to move up the door to its open position and decelerate the falling motion of the door when it is closed, the stay holding tension springs are expanded for closing the door only to less than twice of their length when the door is opened so that the load applied to the stay holding tension springs can be significantly lessened to prolong their effective service life and the door can be operated smoothly and comfortably for a long period of time, if compared with those of a comparable conventional cabinet.

If the above arrangement is further provided with a pair of door holding tension springs, each extending between the related hinge and the lower end of a corresponding grooves arranged on the inner surface of the door, the door is securely moved to is fully open position by a joint effect of the door holding tension springs, the stay holding tension spring, and the slide rail assemblies as it is moved upward, whereas the door may be closed smoothly without requiring any substantial force for supporting the door against its gravity because of a joint effect of the tensile force of the door holding tension springs and that of the stay holding tension springs. Additionally, since the door holding tension springs are accommodated in respective longitudinal grooves arranged on the inner surface of the door, they would not come out from there to esthetically damage the appearance of the cabinet when the door is opened nor accidentally pinch a finger of the user during the operation of opening or closing the door. What is more, since the stay holding tension springs would not come out of the opening of the cabinet main body, they do not provide any hazard to the user.

An overhead door arrangement according to the second aspect of the invention has an additional advantage of damping the torque of the door by means of dampers so that the door is protected against any abrupt closing motion and hence can be closed smoothly and comfortably.

If such an overhead door is further provided with a pair of door holding tension springs, the damping effect of the dampers is further improved by them so that the door may be closed much more smoothly and comfortably.

An overhead door arrangement according to the third aspect of the invention has still another advantage of alleviating the effect of the gravity of the closing door by means of a pair of coil springs so that the door is better protected against any abrupt closing motion and hence can be closed very smoothly and comfortably. Additionally, the door can be opened very lightly because of the resilient force of the coil springs.

If such an overhead door is additionally provided with a pair of door holding tension springs, the net effect will be very great so that the door can be opened and closed very smoothly and comfortably by a joint effect of the stay holding tension spring, the door holding tension springs and the coil springs.

What is claimed is:

1. An overhead door swingably secured to inner lateral wall surfaces of a cabinet by a pair of stays such that a base end of each of the stays is rotatably secured to an inner lateral wall surface of the cabinet and a front end is pivotably fitted to an inner surface of the door at a position close to a lower edge thereof, said door being provided on the inner surface thereof with a pair of longitudinally arranged slide rail assemblies, each slide rail assembly comprising a relatively long outer rail and a relatively short inner rail slidably engaged with each other and, said inner rail being pivotably secured at an upper end to a front edge of a roof wall of the cabinet by a hinge, so that the door can be swung open or closed as a combined effect of slewing and sliding motions and, when fully opened, said door being placed on the roof wall of the cabinet, and a pair of stay holding tension springs, each spring being connected between a point upwardly and forwardly displaced from the base end of the corresponding stay on the inner lateral wall surface of the cabinet and a point in a middle portion of the stay, in order to urge the outer rails and the door upward relative to the inner rails, and a pair of longitudinal grooves for accommodating respective door holding tension springs, each door holding tension spring being arranged between an upper end of a corresponding hinge and a lower end of a corresponding groove, in order to decelerate any downward movement and accelerate any upward movement of the outer rails and the door relative to the inner rails.

2. An overhead door swingably secured to inner lateral wall surfaces of a cabinet by a pair of dampers each having a rotary shaft and a pair of stays such that the rotary shaft of each of the dampers is rigidly secured to an inner lateral wall surface of the cabinet, a base end of the corresponding stay is rigidly fitted to a main body of the corresponding damper while a front end is pivotably fitted to an inner surface of the door at a position close to a lower edge thereof, said door being provided on the inner surface thereof with a pair of longitudinally arranged slide rail assemblies, each slide rail assembly comprising a relatively long outer rail and a relatively short inner rail slidably engaged with each other, said inner rail being pivotably secured at an upper end to a front edge of the roof wall of the cabinet by a hinge, so that the door can be swung open or closed as a combined effect of slewing and sliding motions and, when fully opened, said door being placed on the roof wall of the cabinet, and a pair of stay holding tension springs, each spring being connected between a point upwardly and forwardly displaced from the base end of the corresponding stay on the inner lateral wall surface of the cabinet and a point in a portion of the stay, in order to urge the outer rails and the door upward relative to the inner rails, and a pair of longitudinal grooves for accommodating respective door holding tension springs, each door holding tension springs being arranged between an upper end of a corresponding hinge and a lower end of a corresponding groove, in order to decelerate any downward movement and accelerate any upward movement of the outer rails and the door relative to the inner rails.

3. An overhead door swingably secured to inner lateral wall surfaces of a cabinet by a pair of dampers each having a rotary shaft and a pair of stays such that the rotary shaft of each of the dampers is rigidly secured to an inner lateral wall surface of the cabinet, a base end of the corresponding stay is rigidly fitted to a main body of the corresponding damper while a front end is pivotably fitted to an inner surface of the door at a position close to the lower edge thereof, said door being provided on the inner surface thereof with a pair of longitudinally arranged slide rail assemblies, each comprising a relatively long outer rail and a relatively short inner rail slidably engaged with each other, each slide rail assembly being pivotably secured at an upper end to a front edge of a roof wall of the cabinet by a hinge, so that the door can be swung open or closed as a combined effect of slewing and sliding motions and, when fully opened, said door is placed on the roof wall of the cabinet, a pair of stay holding tension springs, each spring being connected between a point upwardly and forwardly displaced from the base end of the corresponding stay on the inner wall surface of the cabinet and a middle point of the stay, in order to urge the outer rails and the door upward relative to the inner rails, each of said dampers being provided with respective coil springs, each coil spring having opposite ends hooked, respectively, to the rotary shaft and the main body of corresponding damper, such that the coil springs are wound tightly as the door is rotated toward its closed position in order to urge the outer rails and the door upward relative to the inner rails by a resilient force of the coil springs, and a pair of longitudinal grooves for accommodating respective door holding tension springs, each door holding tension spring being arranged between an upper end of a corresponding hinge and a lower end of a corresponding groove, in order to decelerate any downward movement and accelerate any upward movement of the outer rails and the door relative to the inner rails.

* * * * *